United States Patent [19]

Rogers

[11] Patent Number: 5,036,787

[45] Date of Patent: Aug. 6, 1991

[54] MOORING SYSTEM

[76] Inventor: Alan L. Rogers, 1885 Rampart La., Lansdale, Pa. 19446

[21] Appl. No.: 501,014

[22] Filed: Mar. 29, 1990

[51] Int. Cl.[5] ..... B63B 21/00

[52] U.S. Cl. ..... 114/230

[58] Field of Search ..... 114/230; 441/3, 4, 5; 267/166.1

[56] References Cited

U.S. PATENT DOCUMENTS

| | | | |
|---|---|---|---|
| 2,616,684 | 11/1952 | Richter | 267/166.1 |
| 2,996,033 | 8/1961 | Yordi | 114/230 |
| 3,183,877 | 5/1965 | Benzel | 114/230 |
| 3,187,707 | 6/1965 | Carbone | 114/230 |
| 3,195,498 | 7/1965 | Johns | 114/230 |
| 3,492,963 | 2/1970 | Kaiser | 114/230 |
| 4,120,489 | 10/1978 | Burlinghaus | 267/166.1 |
| 4,250,827 | 2/1981 | Booker et al. | 114/230 |

*Primary Examiner*—Sherman D. Basinger
*Assistant Examiner*—Stephen P. Avila
*Attorney, Agent, or Firm*—Joseph W. Molasky

[57] ABSTRACT

A mooring system for securing a boat to a dock wherein masts are supported on the dock at their lower end by a mounting means so as to extend over the water and carry lines attached to the upper ends of the masts and extending therefrom to the boat.

11 Claims, 3 Drawing Sheets

MOORING SYSTEM

BACKGROUND AND SUMMARY OF THE INVENTION

The invention relates generally to mooring systems for boats and, more particularly, to a mooring system of the type wherein masts are supported on the dock at their lower end so as to extend over the water adjacent the dock and carry lines which extend from the upper end of the mast to the boat. This type of mooring system serves to secure a boat in a manner so that it will not bump against the dock while moored. While this type of mooring system is known, there is a need to improve the safety and the simplicity of construction thereof.

It is the general object of this invention to provide a mooring system of the indicated type wherein there is provided a novel means for mounting the lower end of the mast on the dock and there is provided novel means for attaching the line to the upper end of the mast.

In accordance with the general object of the invention, the means for mounting the mast to the dock comprises a base adapted to be secured to the dock, spring means secured at its lower end to the base to extend therefrom in an upright position, and a fitting secured to the upper end of the spring means and providing a mast engaging portion. Further, the mast is provided with a line supporting means at the upper end thereof, such means taking various forms including an eyelet providing member, a hook providing member and a member carrying a pulley.

The improved mooring system in accordance with the invention has several advantages over the prior art systems. Thus, the spring type mounting means provides a very compact and simple arrangement which saves space, provides a good load supporting means, and is safer than the prior art devices which involve a multiple part construction.

DETAILED DESCRIPTION OF THE PREFERRED EMBODIMENTS

Figure 1:
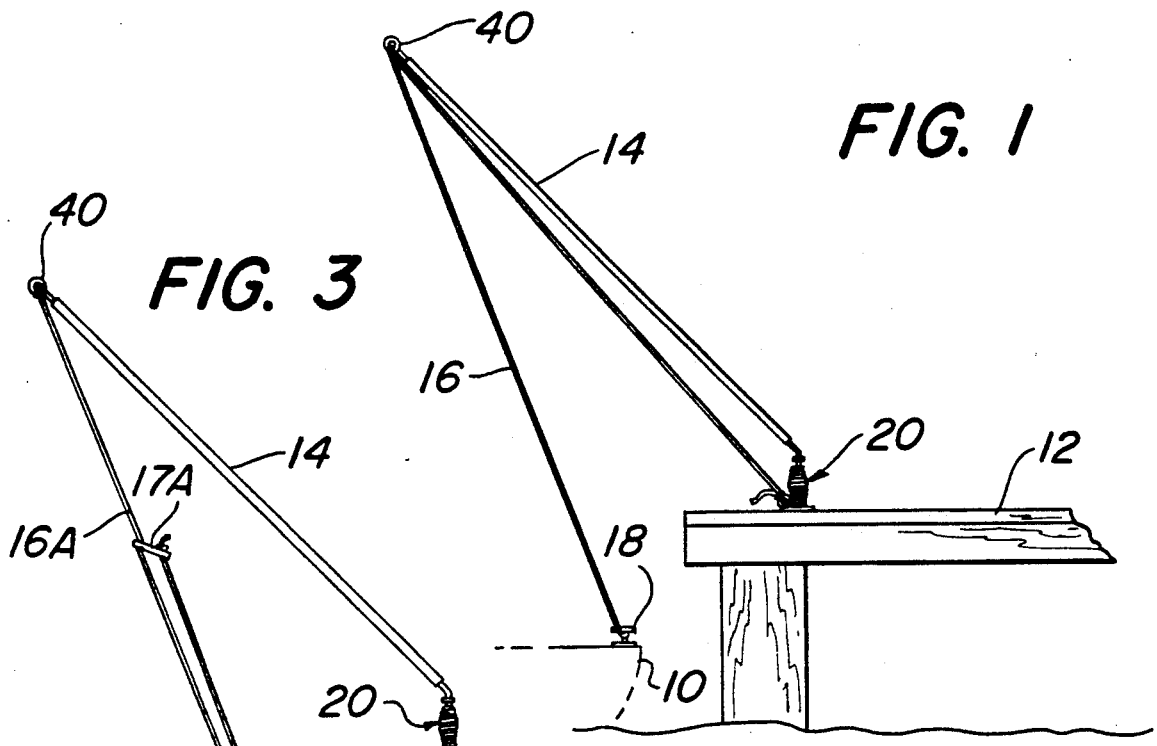
FIG. 1 is an elevational view of a mooring system in accordance with the invention.
Figure 2:
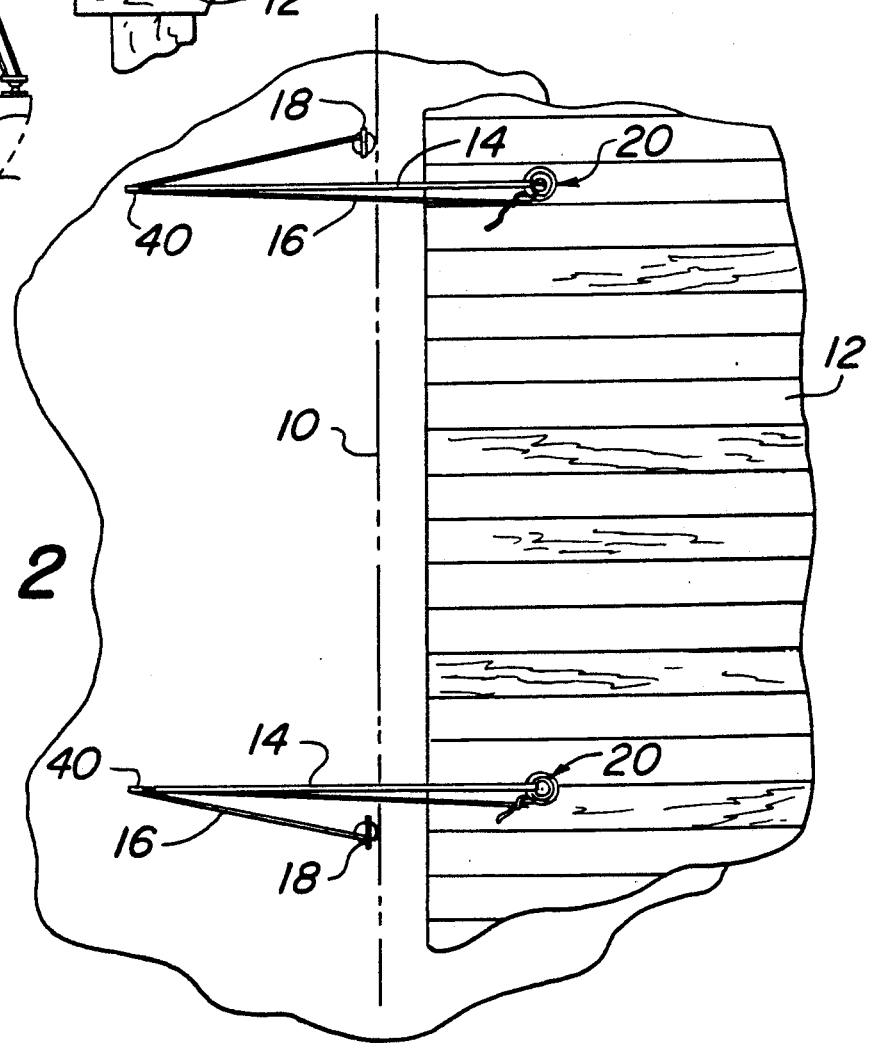
FIG. 2 is a plan view of the mooring system shown in FIG. 1.

In FIGS. 1 and 2 there is shown a mooring system in accordance with the invention wherein a boat 10 is secured to a dock 12 by a pair of masts 14 supported on the dock 12 at their lower ends to extend over the water and carry lines 16 which are extended from the upper end of the masts 14 to cleats 18 on the boat 10 for attachment thereto. The masts 14 have the same construction and each is formed of a flexible plexiglass rod having a hollow configuration. Further, each mast 14 is supported at its lower end on an identical mounting means 20 for mounting the same on the dock 12 in the position as shown in FIGS. 1 and 2.

Figure 4:
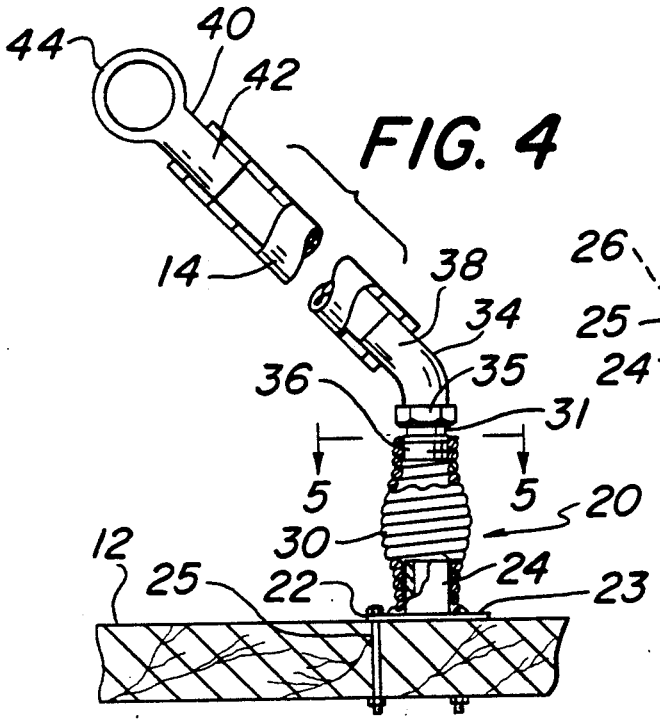
FIG. 4 is a detail view showing the mounting means and mast of the mooring system shown in FIG. 1.
Figure 5:
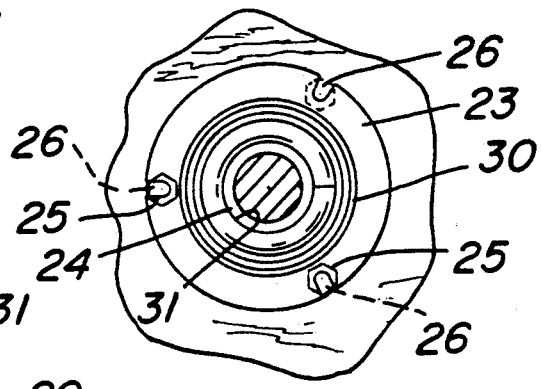
FIG. 5 is a sectional view taken generally on line 5—5 of FIG. 5.

The mounting means 20 is shown in detail in FIGS. 4 and 5 and comprises a base 22 having an annular flange 23 and a cylindrical tube 24. Base 22 is secured to the dock surface by means of three bolts 25 which cooperate with holes or slots 26 formed in the peripheral edges of the flange 23. Mounting means 20 also comprises a spring means 30 secured, as by welding or a press fit, at its lower end to base 22 at tube 24 so as to extend therefrom in an upright position, with tube 24 being received within the lower end of the spring means 30 as shown in the Drawings. The spring means 30 comprises a rigid, tightly coiled spring having a barrel spring construction of a type well known in the art wherein the medial portion of the spring is wider than the end portions thereof, as is shown in FIG. 4. These springs are commercially available and one satisfactory spring is the barrel spring sold by the SPRINGTEC CORPORATION of Kulpsville, Pa. for use in holding antenna masts.

While the spring means 30 may be made of various sizes and materials, one preferred spring sold by SPRINGTEC CORPORATION is made of 17-7 pH corrosion resistant steel wire (stainless steel), said material having a hardness of Rockwell C-38-45. The steel wire has a diameter of 0.281 inches. The spring has a barrel shape with a height of $4\frac{1}{8}$ inches, an internal diameter at its ends of 1.025 inches and a maximum outer diameter at the widest part of the barrel configuration of $2\frac{1}{8}$ inches. The spring has approximately $14\frac{1}{8}$ turns and is ground flat at its ends.

A spring of the above-described specifications is preferred because of its high tensile properties that allow for the spring to experience high stress and still function. Also, the corrosive resistant material is important in applications near salt water environments. Further, the barrel configuration allows for a high stress as compared with springs of other configurations. Accordingly, the combination of the material and the barrel shape produces excellent results.

Further, it is noted that the spring means 30 can be made of larger and higher strength designs if desired. The above-described spring will be satisfactory with boats weighing up to about 40,000 pounds. However, if desired, the spring means 30 can be made to handle 100,000 pounds by using a larger wire size and larger spring dimensions.

The mounting means 20 also comprises a fitting 34 secured to the upper end of the spring means 30 and providing a mast engaging portion. To this end, the fitting 34 has an elbow shape and is provided at its lower end with an externally threaded portion 36 which is adapted to be threadedly received in the upper end of the spring means 30. To this end, the top end of the spring means 30 has an internal thread portion 31 formed thereon and adapted to threadedly engage the external threads on threaded portion 36 on the fitting 34 or another configuration as described hereafter. The upper end 38 of the elbow-shaped fitting 34 is cylindrical and is adapted to fit, with a tight sliding fit, into the interior of the lower end of mast 14 as is best shown in FIG. 4, for example. By reason of the elbow configuration of the fitting 34, the mast 14 is mounted to extend at an upwardly extending angle to the vertical so as to extend over the water adjacent the dock 12. It is noted that the fitting 34 has a hexagonal shaped wrenching portion 35 adjacent the threaded end 36 thereof, which wrenching portion 35 is adapted to be engaged by a wrench or the like for rotating the fitting 34 when it is secured within the spring means 30 by threadedly engaging portion 36 with thread portion 31 or a diameter that can be tightened by use of a pipe wrench.

The mast 14 shown in FIGS. 1 and 2 is provided at its upper end with a line supporting means in the form of a member 40 which has a cylindrical end 42 adapted to fit snuggly within the hollow upper end of mast 14 as is best shown in FIG. 4. Member 40 constructed to provide an eyelet 44 at its extended end, said eyelet 44 being adapted to support the line 16 as is shown in FIGS. 1 and 2. Line 16 is rigged in a conventional manner to extend from the cleat 18 on the boat 10 (whereat one end of line 16 is tied) upwardly to pass through the hole provided by eyelet 34 and downwardly along mast 14 for attachment of the other end of the line 16 to a hook or other suitable means located at mounting means 20 on the top of the dock 12. This rigging arrangement is shown in FIGS. 1 and 2.

Figure 3:
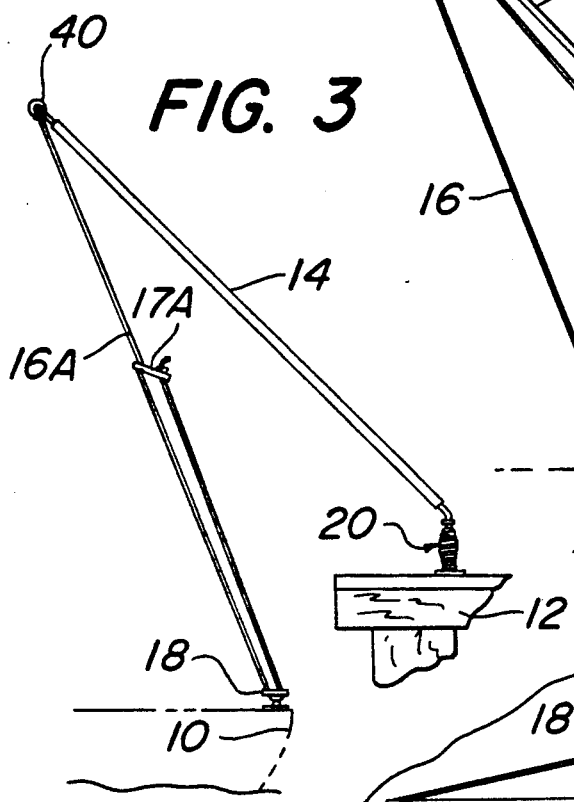
FIG. 3 is an elevational view of another type of mooring system in accordance with the invention.

In FIG. 3 there is shown another type of rigging arrangement used in the art for use with a mast 14 having an eyelet providing member 40 thereon. In accordance with this rigging arrangement, a line 16A is attached at one end to the eyelet member 40 whereat it is knotted and extends downwardly therefrom for engagement with the cleat 18 on the boat. Line 16A is provided with a slip device 17A for adjusting the length thereof to a desired amount, this type of device being known in the art.

Figure 6:
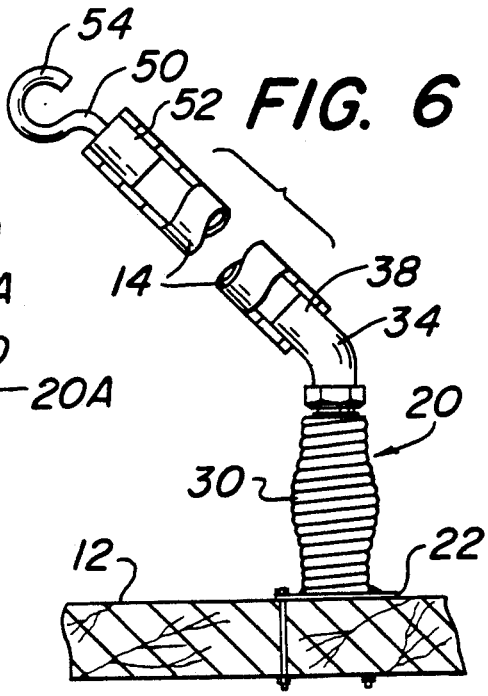
FIG. 6 is a detail view showing an alternate type of mast construction.

In FIG. 6 there is shown another type of line supporting means for use in a mooring system in accordance with the invention. As shown in this figure, a mast 14 is mounted at its lower end on a mounting means 20 comprising a base 22, a spring means 30 and a fitting 34 constructed and arranged as described above. Mast 14 is provided at its upper end with a line supporting means in the form of a member 50 which has a cylindrical end 52 adapted to fit snuggly within the hollow upper end of mast 14. Member 50 is constructed to provide a hook 54 at its extended end, said hook 54 being adapted to support a line 16 for use in the mooring of a boat as described above.

Figure 7:
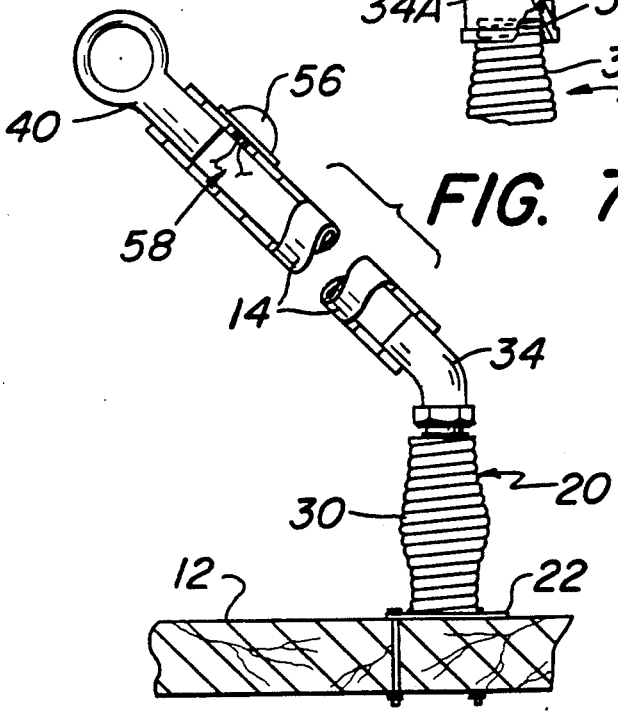
FIG. 7 is a detail view showing a mast construction including a lamp at the upper end thereof.

In FIG. 7 there is shown a mast 14 constructed and arranged in the same manner as the arrangement shown in FIG. 4 except that there is included a lamp at the upper end thereof. Thus, mast 14 is mounted at its lower end on a mounting means 20 comprising a base 22, a spring means 30, and a fitting 34. A member 40 is provided at the upper end of mast 14 to provide a line supporting means thereat. Also, a lamp 56 is mounted at the upper end of mast 14 as shown in FIG. 7. Lamp 56 is supplied with power by means of a pair of electrical lines 58 which extend from the lamp into the interior of the hollow mast 14 as is shown in FIG. 7. The lamp 56 will be turned on during darkness to provide visibility for the docking of a boat.

Figure 8:
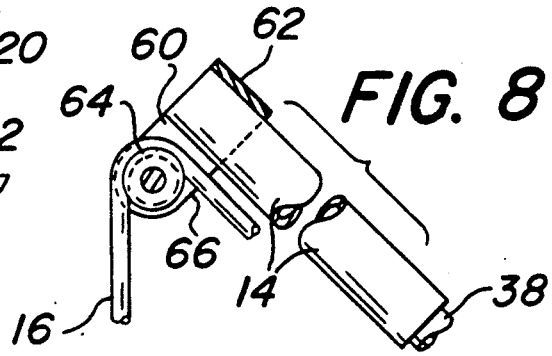
FIG. 8 is a fragmentary view of the upper end of a mast wherein there is provided a pulley for supporting the lines which are connected to the boat.

In FIG. 8 there is shown another type of line supporting means for use in the mooring system of the invention. As shown in this figure, a mast 14 is provided at its upper end with a line supporting means in the form of a member 60 which has a base portion 62 adapted to fit snuggly onto the upper end of the mast 14 as shown in FIG. 8. Member 60 also supports a freely rotatable pulley 64 on extended end portions 66 thereof, which pulley 64 is adapted to support a line 16 as shown in FIG. 8.

Figure 9:
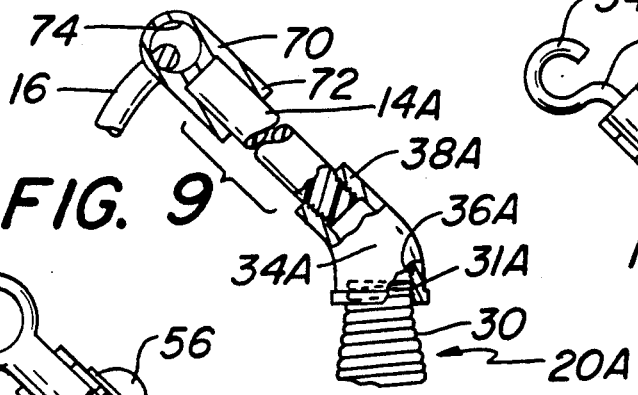
FIG. 9 is a detail view of showing a solid mast construction.

In FIG. 9 there is shown another type of mast and line supporting means for use in the mooring system in accordance with the invention. As shown in this figure, there is provided a mast 14A formed to a flexible plexiglass rod having a solid cylindrical construction. The mast 14A is supported at its lower end on a mounting means 20A. Mounting means 20A is constructed in the same manner as mounting means 20 described above except that there is provided a modified type of fitting 34A and the spring means 30 is modified in a manner to be described hereafter. Thus, the mounting means 20A comprises a fitting 34A secured to the upper end of the spring means 30 and providing a mast engaging portion. Fitting 34A has an elbow shape and is provided at its lower end with an internally threaded portion 36A adapted to be threadedly received onto the upper end of the spring means 30, with the top end of the spring means 30 having an external threaded portion 31A formed thereon and adapted to threadedly engage the internal threads on the threaded portion 36A of fitting 34A. The upper end 38A of the elbow shaped fitting 34A is cylindrical and is adapted to threadedly engage the lower end of mast 14A which is externally threaded as shown in FIG. 9 so as to thread into the internal threads on portion 38A as is shown in FIG. 9.

The mast 14A is provided at its upper end with a line supporting means in the form of a member 70 which has a hollow cylindrical end 72 adapted to fit snuggly onto the cylindrical upper end of mast 14A as is shown in FIG. 9. Member 70 is constructed to provide an eyelet-type opening 74 at its extended end, said opening 74 being adapted to support a line 16 as is shown in FIG. 9.

Figure 10:
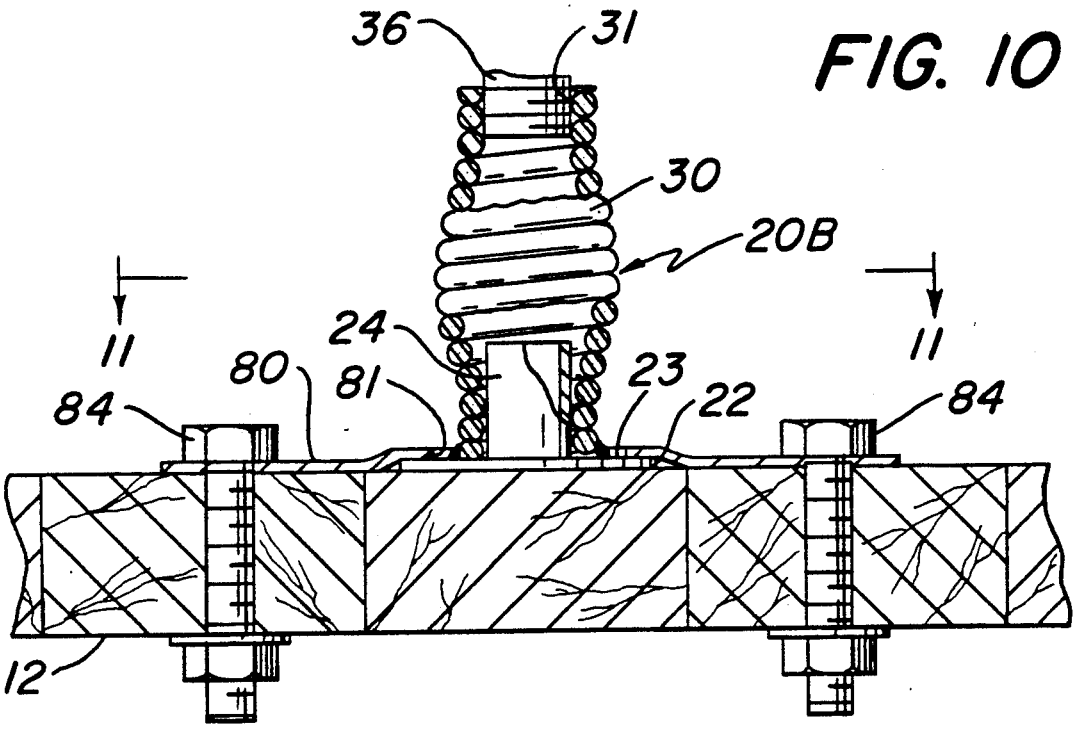
FIGS. 10 is a fragmentary sectional view of another type of mounting means for use in the mooring system in accordance with the invention.
Figure 11:
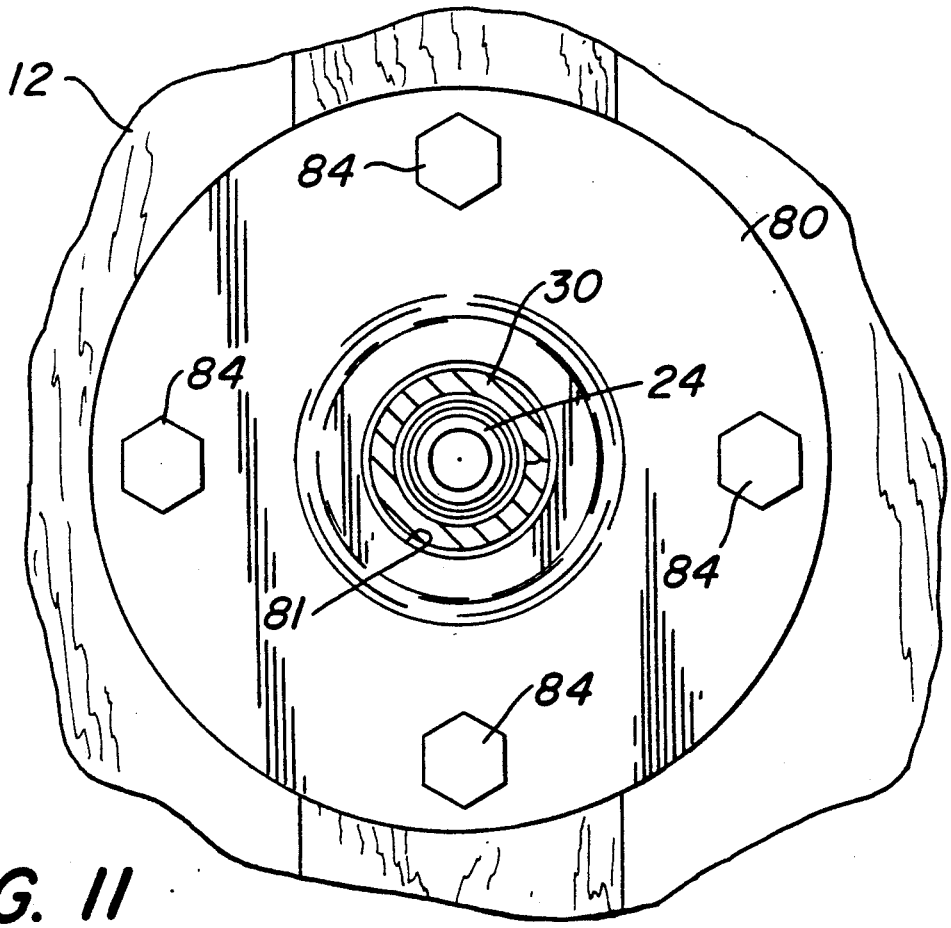
FIG. 11 is a sectional view taken on line 11—11 of FIG. 10.

In FIGS. 10 and 11 there is shown another type of mounting means for use in the mooring system of the invention. This mounting means is particularly useful in applications where the dock does not provide adequate support for other types of mounting means, such as is the case where the dock may have very narrow or broken boards. In this embodiment of the invention, there is provided a mounting means 20B similar to the mounting means 20 in that it comprises a spring means 30 and a fitting 34, which is engaged at the upper end of the spring means 30 by a threaded portion 36 that engages an internal thread 31 at the top of spring means 30. Mounting means 20B also comprises a base 22 having an annular flange 23 and a cylindrical tube 24. The novel feature of the construction of the embodiment shown in FIGS. 10 and 11 is that there is provided a collar 80 that is constructed and arranged to hold the flange 23 of base 22 onto the dock. To this end, the collar 80 has a generally annular configuration and is adapted to fit over the flange 23 in an overlapping relation as shown in FIGS. 10 and 11. Collar 80 has a plurality of circumferencially spaced openings 82 therein for receiving bolts 84 for use in securing the collar 80 to a dock in overlapping relation to the flange 23 of the base 22. The mounting arrangement is shown in detail in FIGS. 10 and 11. It is noted that the collar 80 has an internal circular opening 81 which is larger than the largest diameter of the spring means 30 so that the collar 80 can be fitted over the spring means 30 to the position as shown in FIGS. 10 and 11.

It will be apparent that various changes may be made in the construction and arrangement of parts without departing from the scope of the invention. Thus, the masts 14 and 14A may be made of fiberglass or aluminum and, as described above, may have either a hollow or a solid construction. Further, the elbow shaped fitting 34 may be constructed so that its lower end has a tapered configuration adapted to be pressed into engagement with the upper end of the spring means 30 and its upper end has a hollow configuration so as to engage the exterior of a solid mast. Further, the wrenching portion 35 may have various shapes including a round configuration, in which case it can be tightened by the use of a pipe wrench. Also, the spring means may be designed so that the helical configuration formed by the internal coils thereof provide the threaded means for engagement with the external configuration on the lower end of the fitting 34.

Furthermore, the spring means 30 can be made of other suitable configurations, although the barrel spring configuration is preferred. Thus, for example, the spring means 30 can be made to have either a straight or conical configuration.

What is claimed is:

1. For use in a mooring system for securing a boat to a dock, wherein masts are supported on the dock at their lower end to extend over the water and carry lines which can be extended from the upper end of the masts to the boat for mooring purposes, a combination comprising an elongated rod forming a mast, and means for mounting said mast on a dock including a base adapted to be secured to the dock surface in a horizontal position, a spring means secured at a lower end to said base to extend therefrom in an upright position, said spring means comprising a rigid tightly coiled spring having a barrel spring construction with the medial portions of said spring being larger than the end portions thereof, and a fitting secured to the upper end of said spring means and providing a mast engaging portion, said fitting having an elbow shape so that one end of said fitting extends upwardly at an angle to the vertical, said mast being adapted to be supported on said mounting means to extend upwardly therefrom, the lower end of said mast being adapted to be engaged in said fitting, said mast having a line supporting means at the upper end thereof.

2. The combination according to claim 1 wherein the lower end of said mast has a hollow cylindrical configuration, said one end of said fitting being engagable with said hollow cylindrical mast end.

3. The combination according to claim 1 wherein said line supporting means of said mast comprises a member providing an eyelet and adapted to be mounted on the upper end of the mast.

4. The combination according to claim 1 wherein said line supporting means of said mast comprises a member providing a hook and adapted to be mounted on the upper end of said mast.

5. The combination according to claim 1 wherein said line supporting means of said mast comprises a member mounted on the upper end of said mast, said member carrying a pulley adapted to support a line.

6. The combination according to claim 1 including a lamp means mounted on the upper end of said mast and providing a light visible at night.

7. The combination according to claim 1 wherein said base comprises a generally annular flange secured to the lower end of said spring means, said flange having a plurality of openings therein for receiving bolts or the like for securing the same to a dock.

8. The combination according to claim 1 wherein said elongated rod is made of aluminum or fiberglass.

9. For use in a mooring system for securing a boat to a dock, wherein masts are supported on the dock at their lower end to extend over the water and carry lines which can be extended from the upper end of the masts to the boat for mooring purposes, a combination comprising an elongated rod forming a mast, and means for mounting said mast on a dock including a base adapted to be secured to the dock surface in a horizontal position, a spring means secured at a lower end to said base to extend therefrom in an upright position, said spring means comprising a rigid, tightly coiled spring, and a fitting secured to the upper end of said spring means and providing a mast engaging portion, said fitting having an elbow shape and being mounted on the upper end of said spring so that one end of said fitting extends upwardly at an angle to the vertical, said mast being adapted to be supported on said mounting means to extend upwardly therefrom, the lower end of said mast being adapted to be engaged in said fitting, said mast having a line supporting means at the upper end thereof, the other end of said elbow-shaped fitting being threaded for threaded engagement with said spring, said fitting having a wrenching portion adjacent said threaded end adapted to be engaged by a wrench or the like for rotating said fitting.

10. For use in a mooring system for securing a boat to a dock, wherein masts are supported on the dock at their lower end to extend over the water and carry lines which can be extended from the upper end of the masts to the boat for mooring purposes, a combination comprising an elongated rod forming a mast, and means for mounting said mast on a dock including a base adapted to be secured tot he dock surface in a horizontal position, a spring means secured at a lower end to said base to extend therefrom in an upright position, said spring means comprising a rigid, tightly coiled spring, and a fitting secured to the upper end of said spring means and providing a mast engaging portion, said fitting having an elbow shape and being mounted on the upper end of said spring so that one end of said fitting extends upwardly at an angle to the vertical, said mast being adapted to be supported on said mounting means to extend upwardly therefrom, the lower end of said mast being adapted to be engaged in said fitting, said mast having a line supporting means at the upper end thereof, the lower end of said mast having a solid cylindrical configuration and is externally threaded, said one end of said fitting being a hollow cylindrical configuration with internal threads adapted to be threadedly engaged with said external threads on the lower end of said mast.

11. For use in a mooring system for securing a boat to a dock, wherein masts are supported on the dock at their lower end to extend over the water and carry lines which can be extended from the upper end of the masts to the boat for mooring purposes, a combination comprising an elongated rod forming a mast, and means for mounting said mast on a dock including a base adapted to be secured to the dock surface in a horizontal position, a spring means secured at a lower end to said base to extend therefrom in an upright position, said spring means comprising a rigid, tightly coiled spring, and a fitting secured to the upper end of said spring means and providing a mast engaging portion, said fitting having an elbow shape and being mounted on the upper end of said spring so that one end of said fitting extends upwardly at an angle to the vertical, said mast being adapted to be supported on said mounting means to extend upwardly therefrom, the lower end of said mast being adapted to be engaged in said fitting, said mast having a line supporting means at the upper end thereof, said base comprising a generally annular flange secured at the lower end of said spring means, and including a collar for holding said flange in position on the dock, said collar having a generally annular configuration and being adapted to fit over said flange in overlapping relation, said collar having a plurality of circumferentially spaced openings therein for receiving bolts or the like for securing the collar to a dock in overlapping relation to said base.

* * * * *